US006050166A

United States Patent [19]

Gauler et al.

[11] Patent Number: 6,050,166

[45] **Date of Patent: *Apr. 18, 2000**

[54] NON-CONTACT SHEET MEASUREMENT AND CUTTING DEVICE

[75] Inventors: David A. Gauler, Griffith; David Jeff Strilich, Valparaiso, both of Ind.

[73] Assignee: Strilich Technologies, Inc., Crown Point, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/536,065

[22] Filed: Sep. 29, 1995

[51] Int. Cl.[7] ..... B26D 5/00

[52] U.S. Cl. ..... 83/209; 83/365; 83/367; 83/370

[58] Field of Search ..... 83/365, 367, 370, 83/209, 210, 74, 361, 363, 371

[56] References Cited

U.S. PATENT DOCUMENTS

| | | | |
|---|---|---|---|
| 2,877,846 | 3/1959 | Tobey | 83/365 X |
| 3,060,791 | 10/1962 | Tarczy-Hornoch | 83/365 X |
| 3,445,640 | 5/1969 | Harrison et al. | 83/365 X |
| 3,469,482 | 9/1969 | Lee | 83/365 X |
| 3,845,679 | 11/1974 | Rhotert | 83/370 X |
| 3,922,937 | 12/1975 | Maddox | 83/365 X |
| 3,978,958 | 9/1976 | Zandstra | 83/365 X |
| 4,216,688 | 8/1980 | Cash | 83/365 X |
| 4,366,600 | 1/1983 | Townsend et al. | 83/365 X |
| 4,426,898 | 1/1984 | Friberg | 83/74 X |
| 4,781,317 | 11/1988 | Ditto | 83/74 X |
| 4,944,503 | 7/1990 | Arima | 83/363 X |
| 5,033,341 | 7/1991 | Mussig et al. . | |
| 5,114,230 | 5/1992 | Pryor | 356/372 |
| 5,161,126 | 11/1992 | Marcus | 367/99 |
| 5,214,490 | 5/1993 | Abe et al. | 356/383 |
| 5,549,400 | 8/1996 | Tang et al. . | |
| 5,777,879 | 7/1998 | Sommerfeldt | 83/74 X |

*Primary Examiner*—Kenneth E. Peterson
*Attorney, Agent, or Firm*—Marshall, O'Toole, Gerstein, Murray & Borun

[57] ABSTRACT

A non-contact measurement and cutting device for cutting sheets of predetermined length from a roll of material comprises a frame having feed rollers journalled thereon and a feed roll drive for actuating the feed rollers. Cooperating cutting blades are carried on the frame for cutting the material. Also supported on the same frame or a separate adjacent frame is a conveyor and an optical sensor for sensing the lead edge of material to be cut. The optical sensor can be adjustably positioned between a minimum reference position to enable cutting of a relatively short length of material and a maximum reference position to enable cutting of a relatively long length of material. The control includes a data acquisition, computer, power supply amplifiers, an operator interface, a dual channel converter assembly, a precision linear control and a feed roll motor controller for accurately controlling the position of the camera and the movement of the feed roll motor so as to cut predetermined length of sheet material quickly and with great precision.

15 Claims, 3 Drawing Sheets

NON-CONTACT SHEET MEASUREMENT AND CUTTING DEVICE

BACKGROUND OF THE INVENTION

This invention pertains to a non-contact measurement and cutting device for precisely cutting sheets to predetermined length within tight tolerances.

Previously it was necessary to make a mechanical measurement of a work piece by contact to establish a reference point from which measurement was then taken. The work piece ordinarily had to be in a static condition requiring interruption of the work processing, and adjustment of the feed to effect measurement was a function separate from the measurement.

Various non-contact measurement devices are known. Pryor U.S. Pat. No. 5,114,230 reveals electro-optical apparatus for inspecting work pieces where there is no contact between the inspecting elements and the work piece. The apparatus includes an electro optical sensor comprising a light source illuminating at least one edge of a workpiece, a lens for forming an image of the illuminated edge and an array of photosensitive elements capable of producing an electrical signal in response to light incident thereon.

The Abe et al. U.S. Pat. No. 5,214,490 shows a sheet dimension measurement system comprising camera and flashing devices, one at each corner of a sheet. Each of the sets of camera and flashing device detects absolute coordinates of a corner based on differences in brightness of the standstill picture of each sheet corner taken by the associates camera. However, the known prior art does not provide nor suggest a non-contact measurement and cutting device for precisely cutting sheets to predetermined length with in tight tolerances.

An object of the present invention is to provide a non-contact measurement and cutting device that does not require physical contact with the workpiece to establish a reference for measurement which will precisely cut sheets to predetermined length within tight tolerances.

Another object of the present invention is to provide a non-contact measurement and cutting device that does not interrupt the process in order to obtain a predetermined measurement.

Yet another object of the present invention is to provide a single sensor non-contact measurement and cutting device that is capable of making adjustments to the feed drive as material is fed to obtain the predetermined sheet dimension desired.

Another object of the present invention is to provide a single sensor non-contact measurement device that does not require physical contact with the work piece to precisely measure and process predetermined lengths.

Still another object of the present invention is to measure and record the length of each sheet produced. Other objects and advantages of the present invention will be made more apparent hereinafter.

SUMMARY OF THE INVENTION

This invention pertains to a non-contact measurement and cutting device for cutting material into sheets. On the frame are feed rolls for receiving and moving material. A motor drives the feed rolls. A cutting assembly comprising a fixed blade and a movable flat are carried on the frame. A conveyor is positioned on the frame downstream from the cutting assembly for moving the cut material to a storage area. An optical sensor is adjustably carried on a support for selectively positioning the optical sensor for measurement of a predetermined length of material. A control is provided for activating and stopping the feed roll drive motor in response to a signal from the optical sensor to position a predetermined length of material on the conveyor means and then actuating the movable blade of the cutting assembly to cut a sheet of material having said predetermined length. The optical sensor is associated with a data acquisition computer, power supply amplifiers, an operator interface and dual channel converter assembly to provide a control for accurately controlling the position of the camera and the actuation of the feed roll motor so as to cut predetermined lengths of sheet material quickly and with great precision.

In another aspect, this invention pertains to a non-contact measurement device for precisely measuring and processing predetermined lengths of material. On the frame means for the device are feed means for receiving and moving material. A motor drives the feed means. An optical sensor is adjustably carried on the frame means for selectively positioning the optical sensor for measurement of a predetermined length of material. A control is provided for activating and stopping the motor for drawing the feed means in response to a signal from the optical sensor to position a predetermined length of material for processing. Processing may comprise various events, for example, cutting sheets of predetermined length by complementary fixed and movable elongated cutting blades, or punching or notching the material by suitable punches or tooling. The optical sensor is associated with control components to accurately control the position of the camera and the actuation of the motor so as to accurately measure predetermined lengths of material.

BRIEF DESCRIPTION OF THE DRAWINGS

There is shown in the attached drawing a presently preferred embodiment of the present invention, wherein like numerals refer to like elements in the various views and wherein.

DETAILED DESCRIPTION OF THE PRESENT INVENTION

Figure 1:
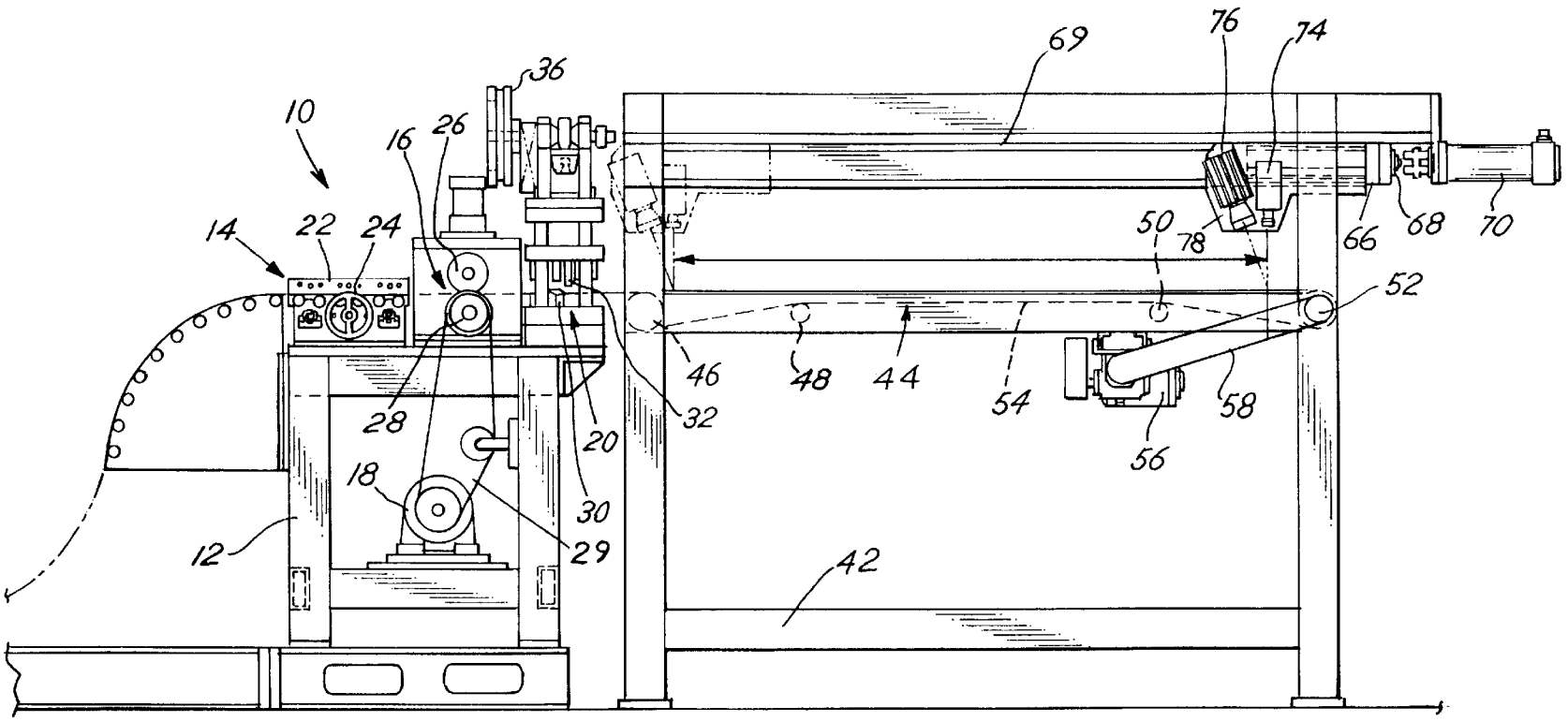
FIG. 1 is a side elevation view of a non-contact measurement and cutting device of the present invention.
Figure 2:
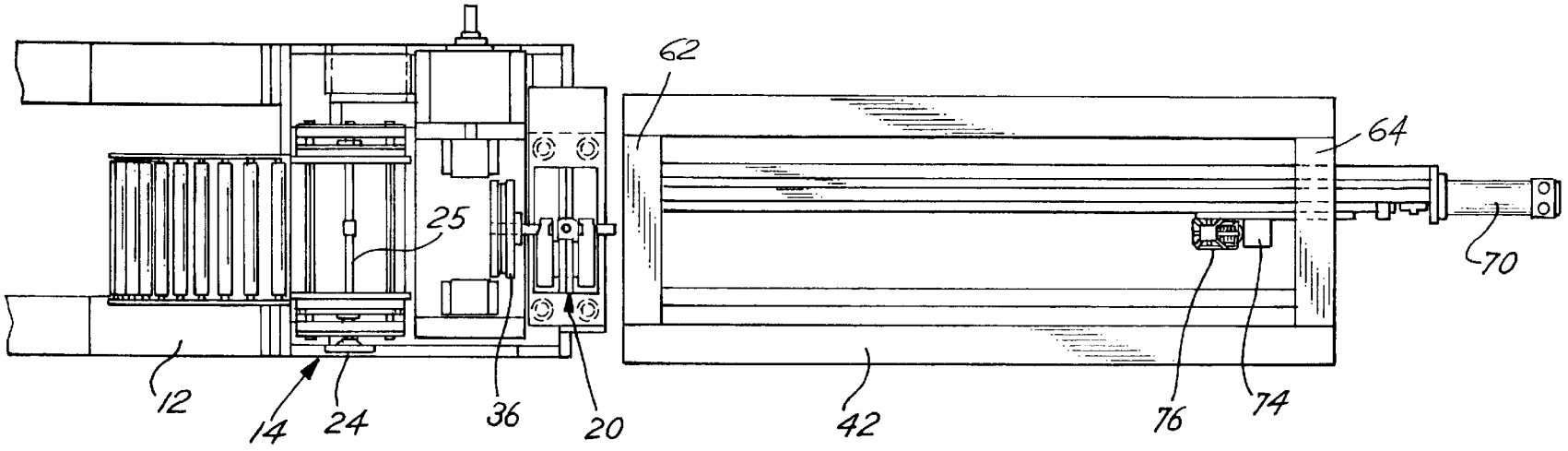
FIG. 2 is a plan view of the non-contact measurement and cutting device.
Figure 3:
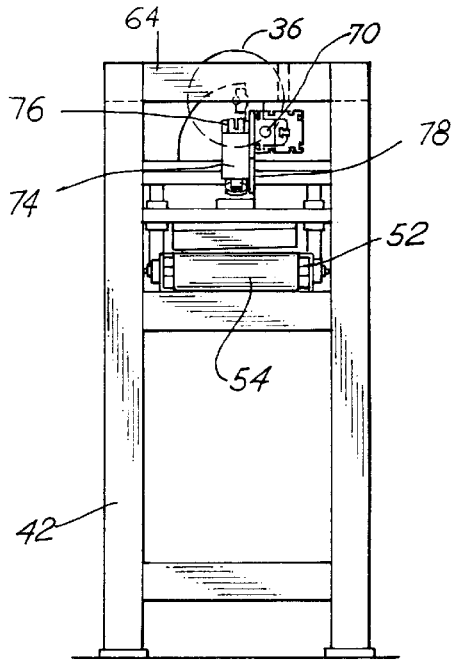
FIG. 3 is an end view of the non-contact measurement and cutting device.

There is shown in FIGS. 1–3 a preferred embodiment of the non-contact measurement and cutting assembly of the present invention. The assembly 10 comprises a frame 12 upon which is mounted an entry feed guide 14, a feed roll assembly 16 driven by a roll feed drive 18 that is operatively connected to the feed roll assembly 16. Also carried on the frame 12 is a shear assembly 20 for cutting sheets of predetermined lengths. Though a feed roll assembly is shown, it will be apparent to persons of ordinary skill in the art that other feed means can be employed for accomplishing a like result, for example, a reciprocating gripper feeder.

Drive 18 may comprise an electrical drive motor which is operatively connected to the feed roll 28 by a belt 29.

Material to be cut to a predetermined size is received from a source, e.g., a roll, and the lead edge is fed through the entry feed guide 14, which comprises a side guide 22 that may be adjusted horizontally by manual handle 24 and screw 25 so material is entrapped on both sides and is ready to be received by rolls 26, 28 of the feed roll assembly 16. The lead edge of the material will be moved past the fixed shear blade 30 and the movable shear blade 32 of the shear assembly 20. The drive 36 for the movable shear blade 32 can be actuated to trim off the end of the material.

Positioned adjacent the frame 12, which is preferably comprised of tubing or like members fixedly secured to one another, is a second frame 42. The second frame 42 may likewise be formed from tubing or like members fixedly secured to one another. Carried on the frame 42 is a conveyor system 44 comprising a plurality of rollers 46, 48, 50 and 52 journalled at their ends in frame 42 and a belt 54 movable on the rollers. Roller 52 is driven from drive 56 by a chain 58. Drive 56 may be an electrical motor.

Formed on the frame 42 is mount plate 62 for receiving a linear actuator assembly 66 that contains a screw 68 journalled at the front and the rear of the housing 69, which is in turn secured to the frame 42. The screw 68 is driven by the positioning drive 70 carried on the support 64.

Disposed on the screw 68 and adapted to be moved thereby from the forward dotted line position to the rear solid line position are an optical sensor 74 and a light source 76. The optical sensor 74 and the light source 76 for better illuminating the lead edge of the material are carried on the bracket 78 that is mounted on the screw 68 and movable between the dotted line position in FIG. 1 representing the shortest length of material to be cut and the solid line position representing the longest length of material to be cut.

In a present embodiment of the invention, the optical sensor 74 is a Honeywell HVS 256-246-PA2 camera and the light source 76, which may be optional for certain applications, is a Honeywell HVL 930-CLS-5HV light. The purpose of the light source 76 to sharpen the camera view of the leading edge material for more precision measurement.

The light source 76 may be mounted adjacent the optical sensor 74 and shine domwnwardly at an angle of about 45° to the axis of the optical sensor (camera) 74. Alternately, the light source 76 may be located beneath the sheet of material to be processed, (for example, cut, punched, or notched), in conjunction with a split conveyor. Such light source can either be fixed on the frame or a travelling light source.

Figure 4:
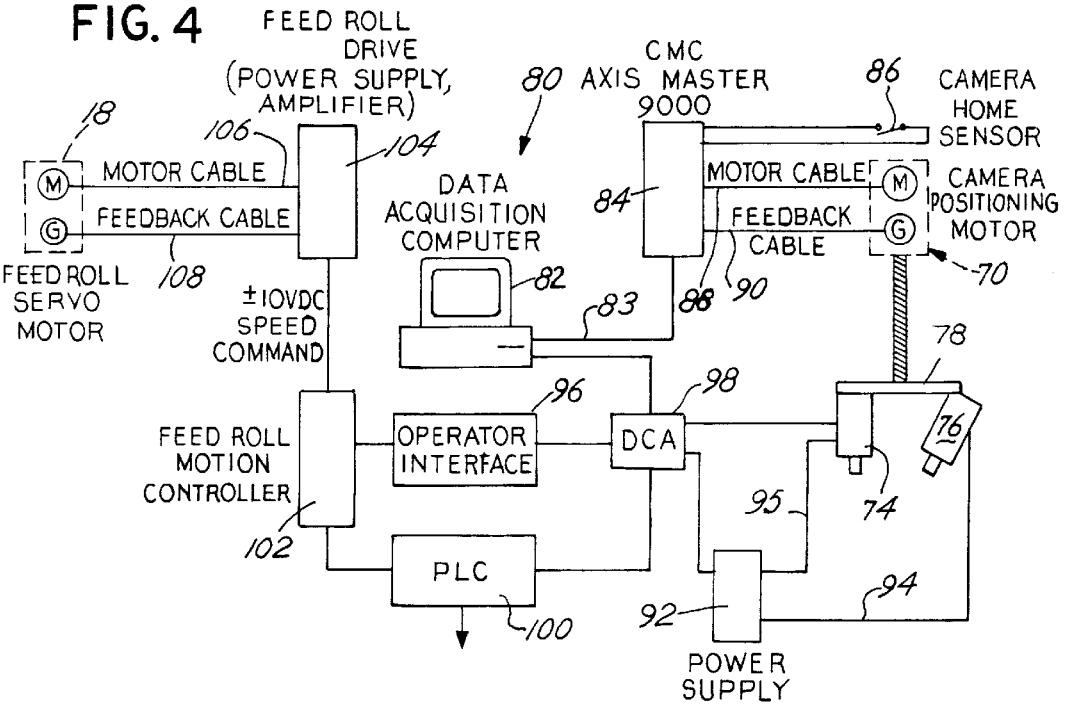
FIG. 4 is an operational schematic diagram of the non-contact measurement and cutting device.

Turning now to FIG. 4, there is shown a schematic illustration of the control means for the non-contact measurement and cutting device of this invention. The control means 80 includes a data acquisition computer 82 for storing and receiving basic operation information. The data acquisition computer 82 will also record the measurement (length) of each piece or sheet produced. In this way, the operator may readily ascertain whether the pieces or sheets are in tolerance, as well as the maximum and minimum variations. The computer 82 transmits information via line 83 to the power supply amplifier or control 84, which may be a CMS Axis Master 9000 device. The amplifier 84 is in circuit with a camera home sensor switch 86. The switch 86 is closed when the bracket 78 which carriers the camera 74 and light source 76 is positioned at zero reference. The camera positioning drive 70, which preferably comprises an electric motor, is connected to the amplifier 84 by a motor cable 88 and a feed back cable 90. The actuation of drive 70 will rotate the screw 68 to selectively position bracket 78 which carries camera 74 and light source 76. The light source 76 is connected to power supply 92 via line 94. The camera 74 is connected to the power supply 92 via line 95.

Other major components of the control means 80 include the operator interface 96, the dual channel converter assembly or DCA 98, the programmable logic controller or PLC 100, the feed roll motion controller 102 and the power supply amplifier 104 through a motor cable 106 and a feed back cable 108.

The control means 80 is capable of accurately controlling the position of the camera and the actuation of feed roll motor so as to cut predetermined lengths of sheet material quickly and with great precision.

The operation of the non-contact measurement and cutting device is as follows.

The operator will thread the lead edge of material into the entry feed guide 22, through the feed rollers 26, 28 and past the shear blades 30 and 32. A crop cut will be made to trim the lead edge and provide an accurate start or zero reference position.

The desired length of cut will be entered into the data acquisition computer 82. The same information will be entered into the operator interface 96.

The operator will set up the job in the data acquisition computer 82 by entering tolerance information, for example, minimum length, and maximum length, and the number of sheets to be cut.

The camera 74 is positioned to the desired position by actuating the camera positioning motor 70. The operator then enters another screen on the data acquisition computer 82. The camera 74 is positioned so as to send a signal to the data acquisition computer 82 when it sees the leading edge of the material to be cut.

Once all components are programmed, the operator can start running the line. The feed roll motor 18 is energized to actuate the feed rolls 26, 28 and feed the material toward the camera 74. If the lead edge of the material is within the preset tolerances as sensed by camera 74, a signal is sent to the data acquisition computer 82. The drive 36 for the shear blade 32 is actuated to sever the predetermined length of sheet. Conveyor means 54 will carry the cut sheet to a disposal or storage place. The feed of material will continue until the desired number of sheets have been cut. The data acquisition computer 82 will record the measurement for each sheet cut so as to readily prove that the products cut on line are within specified tolerances. The data acquisition computer 82 can generate a statistical process control report from the recorded data. There is no need to separately pull from inventory and measure cut sheets to verify that they were within desired tolerances.

If the leading edge of material is not within the desired tolerance, the DCA 98 will transmit new position data to feed roll motion controller 102 by way of the operator interface 96, then the feed roll motion controller 102 will signal the feed roll motor 18 to move the material to align the lead edge within the preset tolerance. When this is accomplished, the shear drive will be actuated to cut the desired length.

There has been provided by the present invention a non-contact measurement and cutting device that can quickly and very accurately cut a predetermined length from a roll of material, for example, sheet metal, or flat metal sheet stock. The device is versatile and can be adapted for processing material in various ways, for example, not only cutting sheets of predetermined length by complementary fixed and movable elongated cutting blades, but also, punching or notching material at predetermined distances by suitable punches or like tooling. The feed mechanism can be feed rolls, as disclosed, or alternately reciprocating feed grippers. In another aspect, the present invention resides in the non-contact measurement device that includes a single optical sensor associated with control components to accurately control the position of the camera and the actuation of the motor for driving the feed mechanism so as to accurately measure predetermined lengths of material or predetermined distances on a continuous sheet of material.

It will be apparent to persons skilled in the art that the invention may be otherwise embodied within the scope of the following claims.

What is claimed is:

1. A non-contact measuring and cutting device for cutting a web of material into sheets of desired length, said device comprising:

a frame;

a conveyor system supported by said frame, said conveyor system being capable of moving said web of material relative to said frame;

a shear assembly capable of making a cut in said web of material;

a control system operatively coupled to control the cutting of said web of material into sheets of material, said control system controlling the cutting of said web of material into sheets of desired length, said control system comprising:

a sensor that senses a leading edge of said web of material;

a controller operatively coupled to said sensor, said controller receiving a signal from said sensor upon said sensor sensing said leading edge of said web of material, said controller being programmed to cause said web of material to be cut by said shear assembly if the position of said leading edge is within a desired tolerance, said controller being programmed to cause said web of material to be repositioned and then cut by said shear assembly if the position of said leading edge is not within said desired tolerance, so that said sheets cut by said shear assembly have a length corresponding to said desired length; and a data storage device that records a length measurement for each of said sheets of material cut by said shear assembly to generate a statistical process control report.

2. A device as recited in claim 1 additionally comprising a sensor support mechanism adapted to support said sensor at a position which is adjustable.

3. A device as recited in claim 2 wherein said sensor support mechanism comprises a linear actuator.

4. A device as recited in claim 1 wherein said conveyor system comprises a feed roll assembly and a plurality of rollers.

5. A device as recited in claim 4 wherein said frame comprises a first frame portion and a second frame portion and wherein said first frame portion supports said feed roll assembly and wherein said second frame portion supports said plurality of rollers.

6. A device as recited in claim 1 wherein said conveyor system comprises a pair of rollers and a motor operatively coupled to drive at least one of said rollers.

7. A device as recited in claim 1 wherein said control system is operatively coupled to said conveyor system.

8. A device as recited in claim 1 wherein said control system is operatively coupled to cause said conveyor system to move said web of material to align said leading edge of said web of material to within said desired tolerance.

9. A non-contact measuring and cutting device for cutting a web of material into sheets of desired length, said device comprising:

a frame;

a conveyor system supported by said frame, said conveyor system being capable of moving said web of material relative to said frame, said conveyor system having a drive motor;

a shear assembly capable of making a cut in said web of material;

a control system operatively coupled to control the cutting of said web of material into sheets of material, said control system controlling the cutting of said web of material into sheets of desired length, said control system comprising:

a sensor that senses a leading edge of said web of material; and a controller operatively coupled to said sensor, said controller receiving a signal from said sensor upon said sensor sensing said leading edge of said web of material, said controller being programmed to cause said web of material to be cut by said shear assembly if the position of said leading edge is within a desired tolerance, said controller being programmed to cause said web of material to be repositioned by activating and stopping said drive motor and then cut by said shear assembly if the position of said leading edge is not within said desired tolerance, so that said sheets cut by said shear assembly have a length corresponding to said desired length.

10. A device as recited in claim 9 wherein said control system comprises a data storage device adapted to record a length measurement for each of said sheets of material cut by said shear assembly to generate a statistical process control report.

11. A device as recited in claim 9 wherein said conveyor system comprises a feed roll assembly and a plurality of rollers.

12. A device as recited in claim 11 wherein said frame comprises a first frame portion and a second frame portion and wherein said first frame portion supports said feed roll assembly and wherein said second frame portion supports said plurality of rollers.

13. A non-contact measuring and cutting device for cutting a web of material into sheets of desired length, said device comprising:

a frame;

a conveyor system supported by said frame, said conveyor system being capable of moving said web of material relative to said frame;

a shear assembly capable of making a cut in said web of material;

a control system operatively coupled to control the cutting of said web of material into sheets of material, said control system controlling the cutting of said web of material into sheets of desired length, said control system comprising:

a sensor that senses a leading edge of said web of material; and a controller operatively coupled to said sensor, said controller receiving a signal from said sensor upon said sensor sensing said leading edge of said web of material, said controller being programmed to cause said web of material to be cut by said shear assembly if the position of said leading edge is within a desired tolerance and, if said leading edge is not within said desired tolerance, said controller being programmed to cause said web of material to be moved so as to align said leading edge within said desired tolerance, and then to cause said web of material to be cut by said shear assembly, so that said sheets cut by said shear assembly have a length corresponding to said desired length.

14. A device as recited in claim 13 wherein said control system is operatively coupled to said conveyor system.

15. A device as recited in claim 14 wherein said conveyor system is operatively coupled to cause said conveyor system to move said web of material so as to align said leading edge of said web of material to within said desired tolerance.

* * * * *